United States Patent [19]

Valentine

[11] 4,364,559

[45] Dec. 21, 1982

[54] LEG EXERCISER

[76] Inventor: John B. Valentine, 4772 Hawley Blvd., San Diego, Calif. 92116

[21] Appl. No.: 218,546

[22] Filed: Dec. 22, 1980

[51] Int. Cl.[3] ..... A63B 21/02

[52] U.S. Cl. ..... 272/142; 272/900

[58] Field of Search ..... 272/142, 135, DIG. 4, 272/70, 96

[56] References Cited

U.S. PATENT DOCUMENTS 807,670 12/1905 Grabner ..... 272/142

2,720,396 10/1955 Pfaus ..... 272/142

*Primary Examiner*—Richard C. Pinkham

*Assistant Examiner*—William R. Browne

*Attorney, Agent, or Firm*—Charmasson, Branscomb & Holz

[57] ABSTRACT

A leg exerciser is provided in two hinged panels or subframes, each of which mounts parallel tracks in which slides a stirrup-foot piece which is connected through a rope and pulley system to a resistance spring so that each foot piece individually resists translation and acts as an exercise device for both feet individually, the two panels being collapsible together along their hinge line for storage when not in use.

3 Claims, 8 Drawing Figures

LEG EXERCISER

BACKGROUND OF THE INVENTION

There are, of course, a lot of both marketed and unmarketed devices for use in exercising particular parts of the body, including the feet. Devices for use in exercising the feet include bicycle exercisers, ropes on the end of stirrups sometimes coupled through pulleys which are connected to the top of a door hinge and may cooperate through the arms and hands to exercise the entire body, and undoubtedly a variety of others.

Ordinarily these exercise devices suffer from one or more deficiencies in that either it's a relatively large, expensive piece of equipment such as an exercise bicycle which is not easily stored, or it relies on external support systems such as pulley and rope exercisers, or it is not muscle-specific and may involve exercises of the muscles which the exerciser really isn't interested in.

There is a need for a mechanism to exercise the leg muscles in substantially the same manner as does the exercise bicycle, but permitting such exercise to take place with a minimum investment in the equipment, and by utilizing a piece of equipment which is readily stored in a closet or other small, out of the way nook, and which can be used while reading, writing, or even eating, in a reclined or upright position, respectively, in a bed or in a chair.

SUMMARY OF THE INVENTION

The present invention fulfills the above stated need by providing a generally planar device which is hinged to collapse for storage and when extended for use utilizes a U-shaped channel frame with the same framing material preferably being mounted inside the frame and used as sliding tracks in which the foot piece slides ride. The foot piece slides are individually resisted by sash-extension springs mounted in the sides of the frame channels and connect to the foot pieces by ropes and pulleys so that the feet may be reciprocated up and down in the frame individually much as a bicycle.

By the provision of a pair of hinged or pivoted feet at the bottom of the frame, when the frame is extended horizontally as, for example, in a bed, the bottom end can be elevated a couple of inches to make room for the heels, to permit exercise in the supine position.

DETAILED DESCRIPTION OF THE PREFERRED EMBODIMENT

The frame of the device is generally square as indicated at 10 and in the preferred embodiment which is collapsible is actually provided as two sub-frames 12 which are hinged along their meeting line at 14. Each of these sub-frames 12 is made of a rectangular continuous U-shaped channel 16, the inner leg of which mounts the common hinge 14.

Figure 6:
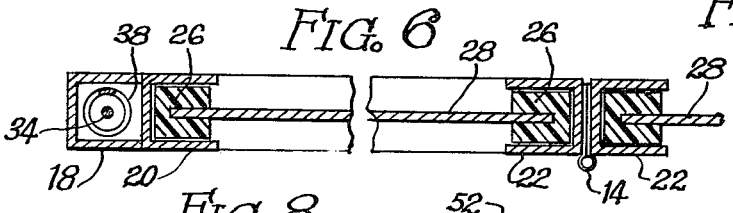
FIG. 6 is a section taken along line 6—6 of FIG. 1.

Inside the outer side members 18 of the frame 10 are mounted two more parallel channels 20 each of which cooperates with a respective inner side 22 of the sub-frames 12 to form inwardly facing parallel tracks. This relationship is best seen in FIG. 6.

Inside these track pairs defined by channels 20 and 22 in each of the sub-frames 12 rides a foot piece 24 formed of a pair of runners 26 which could be made of plastic or nylon and which mount therebetween a web 28 which spans the space separating the runners.

Figure 7:
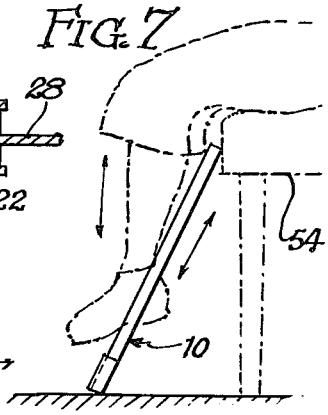
FIG 7 is a diagrammatic representation of the exerciser in use on a chair.
Figure 8:
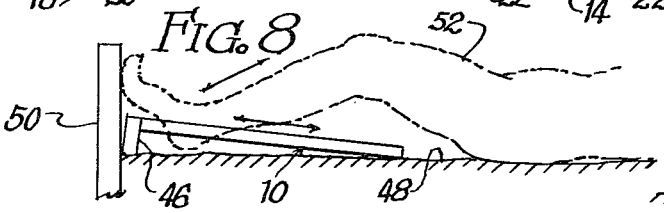
FIG. 8 is a diagrammatic representation of the exerciser being used horizontally on a bed.

The web defines a central opening 30 and a bottom flange 32 to create a flattened place for resting the arch or heel of the foot and defines a stirrup-like configuration capable of accepting the heel through the opening 30 as can be seen in the operational FIGS. 7 and 8.

The tops of each of the foot pieces 24 are connected through ropes 34 and pulleys 36 to extension springs 38 which are mounted inside the channels 18 of the main frame and fixed at the bottom by pins 42. Both foot pieces can thus be seen to be independently operable so that they can be operated in phase, or more commonly out of phase as in a bicycle mode.

Figure 3:
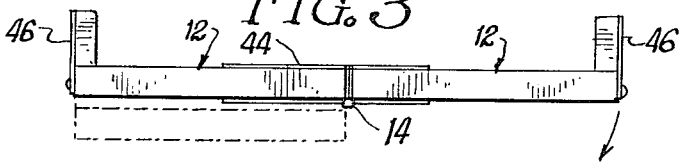
FIG. 3 is a top elevation view of the exerciser as seen in FIG. 1.
Figure 5:
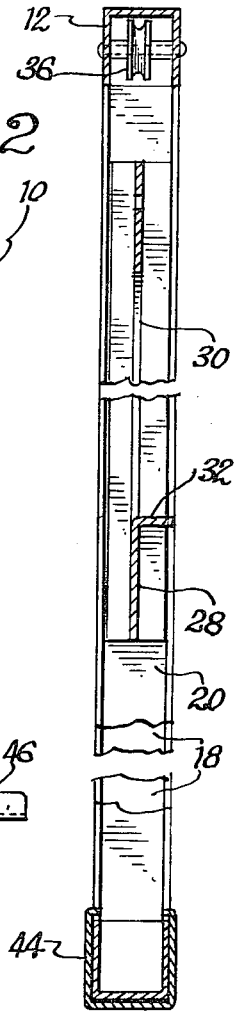
FIG. 5 is a section taken along line 5—5 of FIG. 1.
Figure 1:
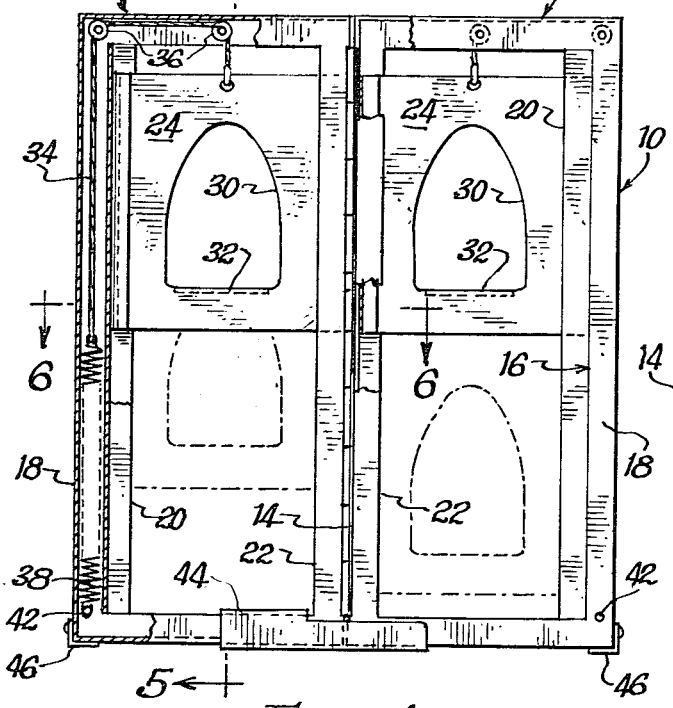
FIG. 1 is a front elevation view of the exerciser showing the down position in phantom.
Figure 2:
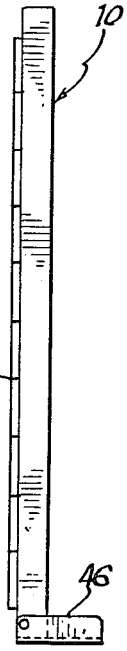
FIG. 2 is a side elevation view from the right side of FIG. 1.
Figure 4:
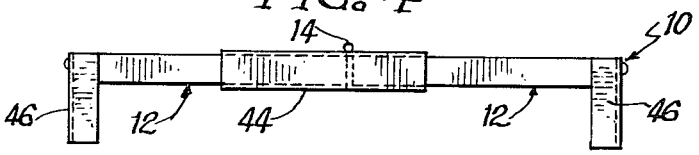
FIG. 4 is a bottom elevation view of the exerciser as shown in FIG. 1.

Additionally, slide 44 alternatively fixes the two sub-frames in planar relation as shown in FIGS. 1 and 4, or can be slid to the right as shown in those figures to release the sub-frames for collapsing along the hinge line as shown in FIG. 3 in dotted line. Also on the bottom of the frame are a pair of L-shaped hinged legs 46 which will fold flush up against the side channels 18 or can be extended for use in a horizontal position as shown in FIG. 8. In this mode of utilization, the exerciser is laid on a generally flat surface such as bed 48 and braced against something such as the foot of the bed 50. The legs 52 are then in a position to exercise when the body is reclined on the bed, and the user may read while exercising the feet and legs, thus doubling the efficacy of his or her time.

FIG. 7 illustrates utilization of the exerciser while inclined against a chair 54, again permitting the user to read, file nails, or do anything else that can be done while sitting while simultaneously exercising the legs. This feature coupled with the dual supine and upright modes of utilization and the folding storage mode shown in phantom in FIG. 3, make the invention an extremely practical exerciser that fulfills a definite gap in the prior art.

It should be understood that the springs 38 may be selected in accordance with the strength of the patient, and may be upgraded from time to time in order to accommodate progress in the patient's muscular rehabilitation.

While only the preferred embodiment of the invention has been described, modification may be made thereto, and other embodiments may be implemented without departing from the spirit and scope of the claims.

What is claimed is:

1. A portable leg exerciser comprising:

(a) a frame having two sub-frames each defining parallel tracks;

(b) two foot pieces engageable by the left and right feet respectively and slideable in said respective sub-frames;

(c) resistance means reacting against the sliding of said foot pieces in said sub-frames in at least one direction whereby the feet and legs are exercised by overcoming said resistance means; and, (d) said two sub-frames being hinged together along an axis parallel to the direction of sliding of said foot pieces to permit said frame to collapse for storage.

2. Structure according to claim 1 and including a sliding bracket mounted on one of said sub-frames and slideable to alternatively release or to fixedly engage the other of said sub-frames such that in the fixed mode said sub-frames are co-planar and adapted for simultaneous use of said foot pieces.

3. Structure according to claim 1 wherein said resistance means comprises a separate extension spring mounted on each of said sub-frames and respectively to said foot pieces by means of respective pulleys and ropes, said frame is made of a generally continuous channel and portions of said channel house said springs, and said parallel tracks are also defined by channels and said foot pieces each comprising parallel runners engaged in said channel tracks and a central metal web spanning between said runners and having a hole therein to define a foot stirrup and a bent flange defining the bottom of said foot stirrup.

* * * * *